US005893594A

United States Patent [19]

Zarzycki, Jr.

[11] Patent Number: 5,893,594

[45] Date of Patent: Apr. 13, 1999

[54] SECURITY ASTRAGAL

[76] Inventor: Vincent Zarzycki, Jr., 9098 Diplomat Pl., Philadelphia, Pa. 19115

[ * ] Notice: This patent is subject to a terminal disclaimer.

[21] Appl. No.: 08/899,601

[22] Filed: Jul. 24, 1997

Related U.S. Application Data

[63] Continuation of application No. 08/568,978, Dec. 7, 1995, Pat. No. 5,678,871.

[51] Int. Cl.[6] ..... E05B 17/00

[52] U.S. Cl. ..... 292/346

[58] Field of Search ..... 292/346, DIG. 21, 292/DIG. 53, DIG. 64, DIG. 70; 70/416, 417, 418; 49/460, 462, 506, 366, 367; 52/207, 210, 204.1

[56] References Cited

U.S. PATENT DOCUMENTS

| | | | |
|---|---|---|---|
| 1,324,018 | 12/1919 | Mumbrauer | 292/DIG. 21 |
| 3,060,523 | 10/1962 | Benham | 49/460 X |
| 3,645,045 | 2/1972 | Gervis et al. | 292/346 X |
| 3,649,060 | 3/1972 | Ruff | 292/42 |
| 3,761,119 | 9/1973 | Bennett et al. | 292/346 |
| 4,237,712 | 12/1980 | Cramer | 70/417 |
| 4,484,463 | 11/1984 | Hennessy | 292/346 |
| 5,131,189 | 7/1992 | Mascotte | 292/346 |
| 5,350,207 | 9/1994 | Sanders | 292/335 |
| 5,415,020 | 5/1995 | Allenbaugh | 292/346 X |
| 5,483,771 | 1/1996 | Herbst | 49/504 |
| 5,547,239 | 8/1996 | Allenbaugh | 70/416 |
| 5,678,871 | 10/1997 | Zarzycki, Jr. | 292/346 |

FOREIGN PATENT DOCUMENTS

| | | |
|---|---|---|
| 37315 | 1/1936 | Netherlands . |

OTHER PUBLICATIONS

"Thresholds and Weatherstrips", Reese Enterprises, Inc., 1995/1996 Catalog/Brochure of Products.

Pemko 1995 Catalog.

*Primary Examiner*—Darnell M. Boucher

*Attorney, Agent, or Firm*—Woodcock Washburn Kurtz Mackiewicz & Norris LLP

[57] ABSTRACT

Disclosed is a security astragal that is secure against unauthorized removal but can be easily removed when authorized so that the door can be subsequently reused without the astragal. The disclosed security astragal includes a security bar that protects against tampering with the door latching mechanism and a protective sheath that secures the security bar from unauthorized removal.

26 Claims, 4 Drawing Sheets

FIG. 3
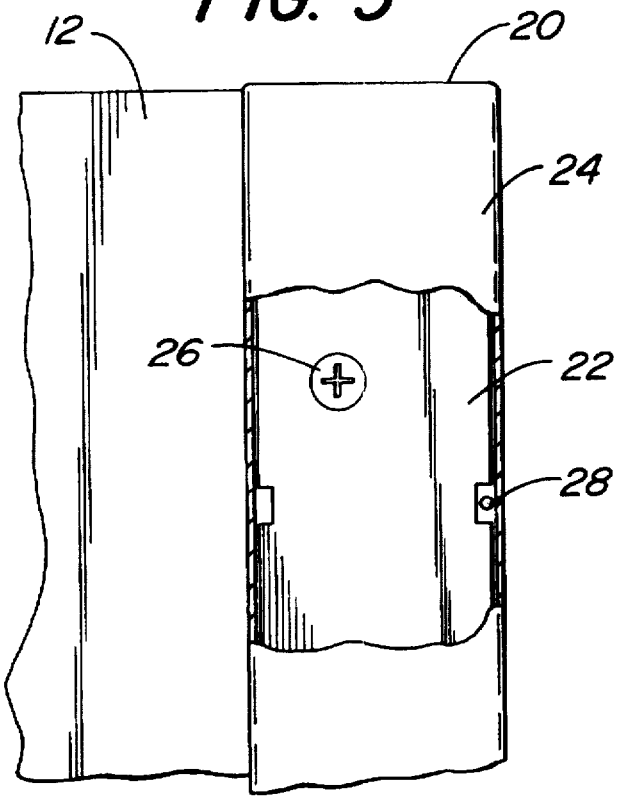
FIG. 4
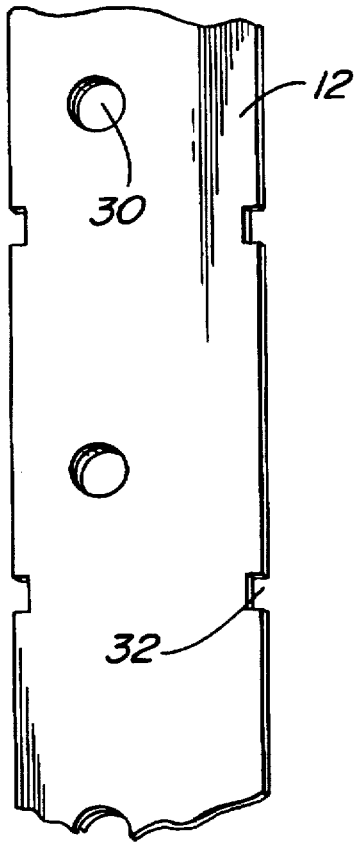
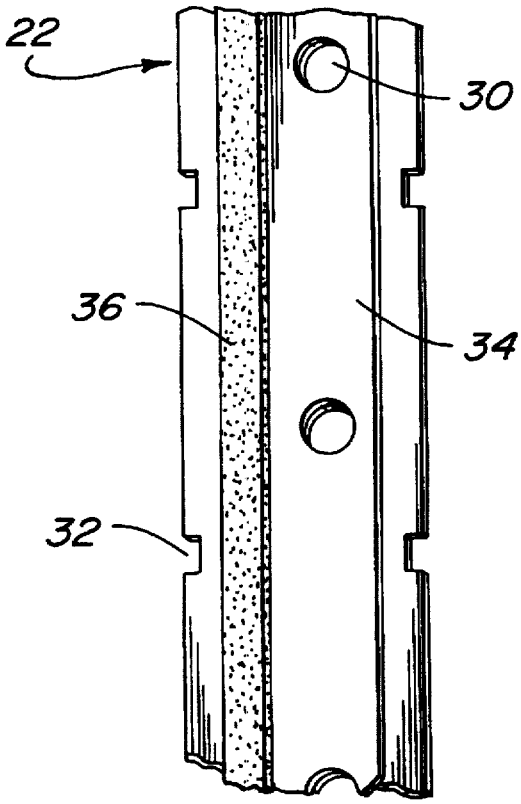
FIG. 5

FIG. 9
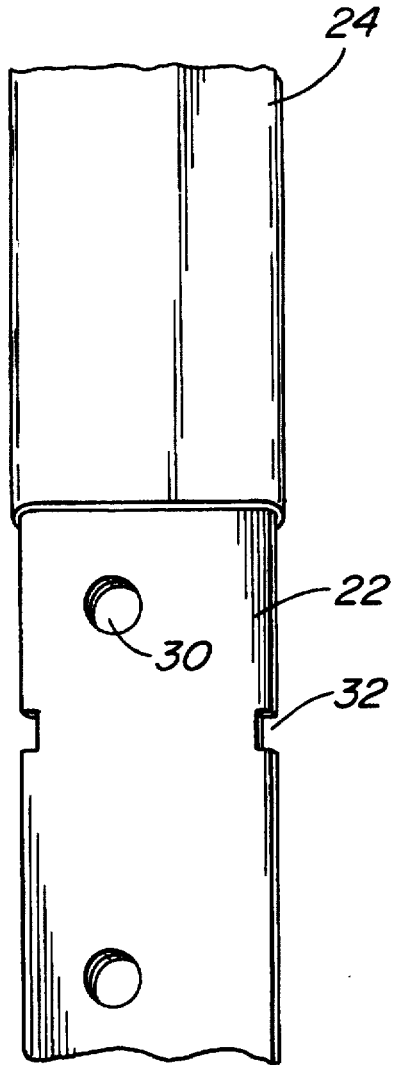
FIG. 7
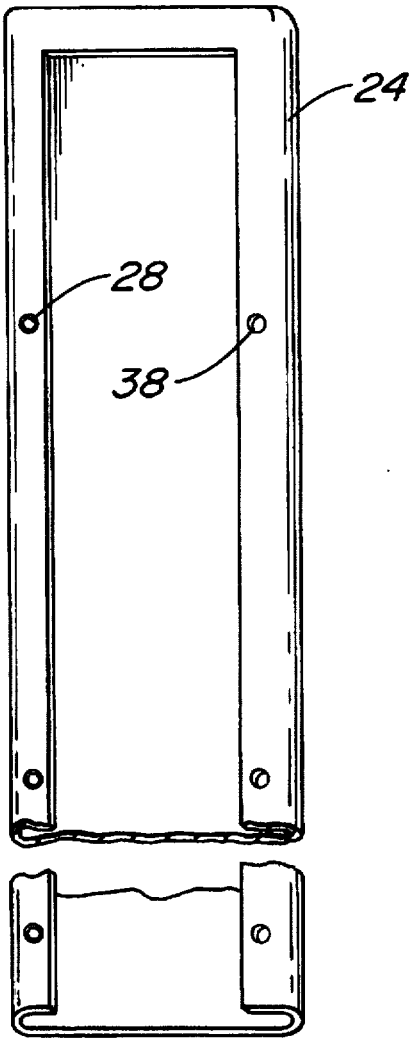
FIG. 6
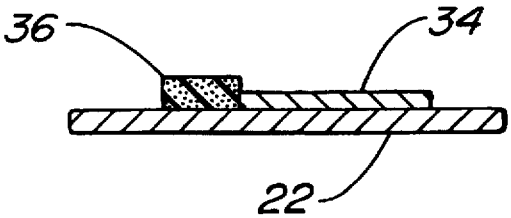
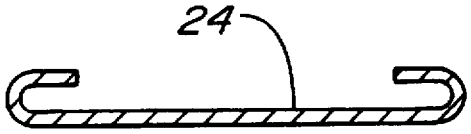
FIG. 8

SECURITY ASTRAGAL

This is a continuation of application Ser. No. 08/568,978, filed Dec. 7, 1995 now U.S. Pat. No. 5,678,871, the disclosure of which is herein incorporated by reference.

FIELD OF THE INVENTION

The present invention relates generally to a security astragal used to secure a door latching mechanism from tampering. More particularly, the present invention relates to an improved astragal device that can be easily installed on and removed from new and existing doors but is also secure against unauthorized removal.

BACKGROUND OF THE INVENTION

Double entrance doorways are commonplace in residential and business settings. Typically, one door in a double doorway remains closed and is referred to as the inactive leaf. The other door, commonly referred to as the active leaf, is used as the main entrance door. Generally, the mating edges of the active and inactive doors do not directly contact each other, but are separated by a slight gap. This gap, when exposed, provides room for tampering with the door latching mechanism.

An astragal's primary function is to cover the gap between double doors and thus secure the door latching mechanism. Typically, an astragal is attached along the exterior edge of the inactive door so as to cover the gap between the active and inactive door leaves.

FIG. 1 depicts a standard double door arrangement employing a prior art astragal 10. As shown, an astragal 10 is affixed to and runs the length of the inactive leaf 12. When the active leaf 14 is in the closed position, the astragal 10 functions to cover the gap between the active 14 and inactive 12 leaves so as to prevent tampering with the door latching mechanism.

FIG. 2 depicts a partial view of a typical inactive door leaf 12 with an attached astragal 10. As shown, the astragal 10 overlaps the edge of the inactive leaf 12. The overlap is large enough to bridge a gap that may exist between the inactive 12 and active 14 leaves when both are in the closed position. By bridging the gap between the door leaves, the astragal protects the latching mechanism from compromise.

A problem not addressed by the prior art is securing the astragal against unauthorized removal while also providing the flexibility for quick and easy authorized removal. One prior art method of attaching an astragal is to drill anchoring screws through the exterior face of the astragal. An astragal attached in this fashion serves the purpose of obstructing attempts to manipulate the latching mechanism between doors. However, an astragal attached with exposed anchoring screws could potentially be removed without authorization by unscrewing the exposed screws. Unauthorized removal of the astragal would leave the latching mechanism exposed to potential tampering.

Another prior art method of securing an astragal is to weld the astragal to the door. Generally, the welded bonds between the door and the astragal are permanent and cannot be broken. Although welding assures against unauthorized removal of the astragal, it also precludes the astragal from being removed so that the door can be reused without the astragal. Similar techniques of permanently affixing an astragal to the door also assure against unauthorized removal but likewise preclude authorized removal and subsequent reuse of the door without the astragal.

Accordingly, a primary goal of the present invention is to provide a security astragal that is secure against unauthorized removal but which permits authorized removal and subsequent reuse of the door without the astragal.

SUMMARY OF THE INVENTION

The present invention provides a security astragal that can be easily installed and removed from a door but which is secure against unauthorized removal. The invention marks a significant improvement over the prior art by providing substantial time savings during installation, assures uncompromising security, and provides the flexibility of reusing the door without the astragal.

In one presently preferred embodiment of the invention, the security astragal 20 comprises a security bar 22 that is fastened with anchoring screws 26 to the exterior door edge. The security bar 22 runs the length of the door, covering the gap between doors. The security bar therefore functions to secure the door latching mechanism from compromise.

The astragal 20 also comprises a protective sheath 24. The protective sheath 24 prevents unauthorized removal of the security bar 22. The protective sheath 24 envelopes the security bar 22 and, by so doing, prevents access to the security bar anchoring screws 26. By controlling access to the anchoring screws 26, the protective sheath 24 functions to protect the security bar 22 from unauthorized removal.

The protective sheath 24 is secured to the security bar 22 with securing screws 28 that are driven from the interior of the door. Because the securing screws 28 are driven from the interior of the door, they are not accessible from the exterior face of the doorway. Therefore, when the double doors are closed, the protective sheath 24 and the underlying security bar 22 cannot be removed by a person with access from the exterior of the doorway.

However, the protective sheath 24 can be removed quickly and easily by a person with access from the interior of the doorway. The protective sheath 24 is removed simply by unscrewing the protective sheath securing screws 28. With the protective sheath 24 removed, the security bar 22 can be easily removed by unscrewing the exposed anchoring screws 26.

The present invention therefore provides a security astragal 22 which prevents compromise of the door latching mechanism and insures that the astragal cannot be removed without authorization. Additionally, the present invention provides the flexibility to easily remove the security astragal 20 so that the door can be subsequently used without the astragal.

Other features of the present invention are described below.

BRIEF DESCRIPTION OF THE DRAWINGS

FIG. 3 is an enlarged front view of an astragal in accordance with the present invention.

Fig. 4 is a perspective view of a security bar in accordance with th resent invention.

FIG. 5 is a view of a security bar from a perspective opposite of that depicted in FIG. 4.

FIG. 6 is a sectional view of a security bar.

FIG. 7 is a perspective view of a protective sheath in accordance with the present invention.

FIG. 8 is a sectional view of the protective sheath.

FIG. 9 is a perspective view of the security bar partially enveloped in the protective sheath.

DETAILED DESCRIPTION OF PREFERRED EMBODIMENTS

Figure 1:
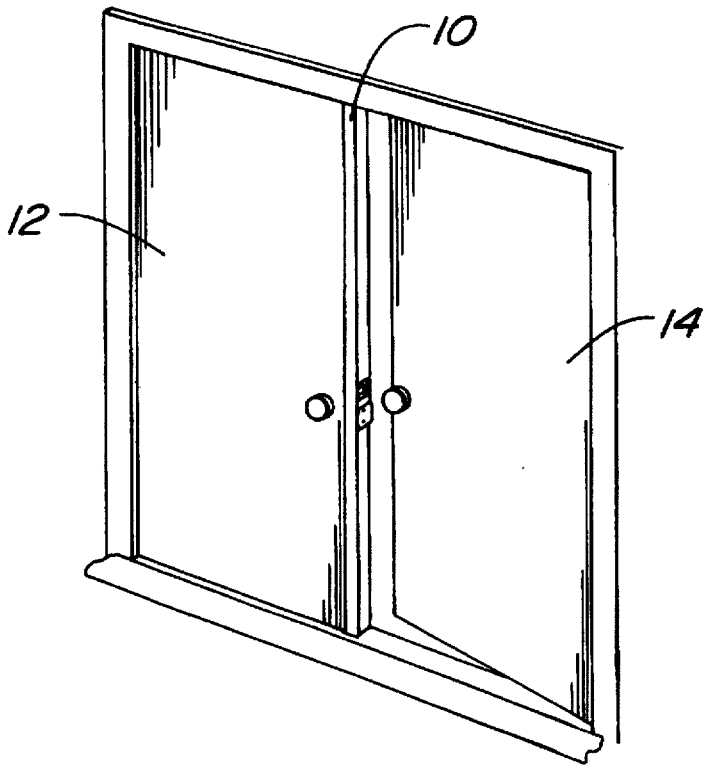
FIG. 1 PRIOR ART
FIG. 1 is a perspective view of a prior art astragal applied in a standard double doorway.
Figure 2:
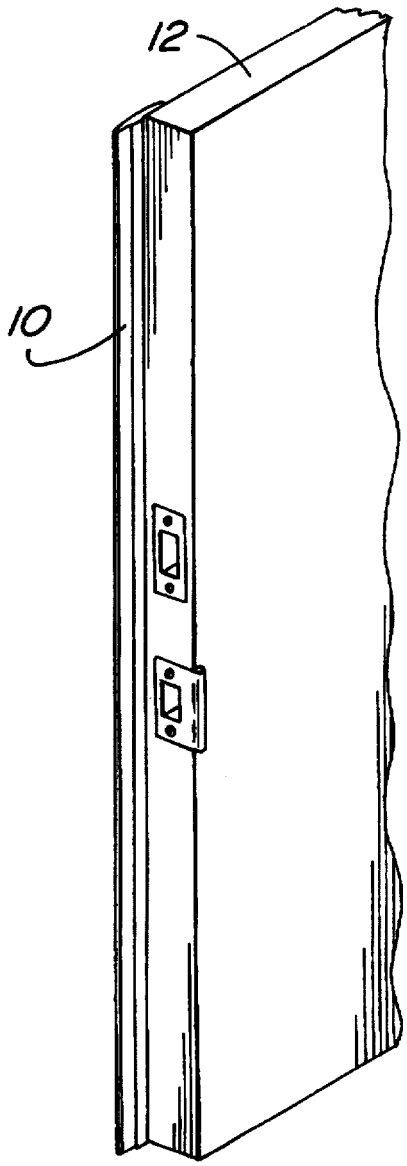
FIG. 2 PRIOR ART
FIG. 2 is a perspective view of a prior art astragal.

FIGS. 3 through 12 depict one presently preferred embodiment of the invention, distinguish the invention from the prior art, and demonstrate the beneficial characteristics of the invention.

FIG. 3 is a perspective view, partially in section, of a security astragal in accordance with the present invention. As shown, a security bar 22 is anchored to the edge of a standard door 12 with security bar anchoring screws 26. A protective sheath 24 envelopes the exterior portion of the security bar 22 so that the security bar anchoring screws 26 cannot be accessed. Both the protective sheath 24 and the security bar 22 may be made of metal of sufficient strength to obtain a U.L. rating. With the protective sheath 24 in place, the security bar 22 cannot be removed without removing the protective sheath 24.

The protective sheath 24 is secured to the security bar with protective sheath securing screws 28 that are driven from the interior of the doorway. The presently preferred security screws 28 comprise allen screws but other types of screws and entirely different means of securing, such as nuts and bolts, could also be employed to attach the protective sheath 24 to the security bar 22. Because the securing screws 28 are driven from the interior of the door, they are not accessible from the exterior face of the doorway. Therefore, when the double doors are closed, the protective sheath 24 and the underlying security bar 22 cannot be removed by a person with access from the exterior of the doorway.

FIGS. 4, 5, and 6 illustrate additional features of the security bar. FIG. 4 provides a frontal view of a representative portion of the security bar 22. The security bar 22 has multiple securing holes 30 through which the security bar anchoring screws 26 are inserted for the purpose of securing the security bar 22 to the door 12. In the presently preferred embodiment, the securing holes 30 are slightly offset from center so that a portion of the security bar 22 will overlap the edge of a door 12 when attached thereto. Also, multiple protective sheath securing notches 32 are located along the edges of the security bar 22. The protective sheath securing notches 32 accept protective sheath securing screws 28 that extend from the protective sheath 24 when the protective sheath 24 is in place over the security bar 22. With the protective sheath screws 28 inserted in the notches 32, the protective sheath 24 is secure and cannot be removed.

FIG. 5 depicts a representative portion of the security bar 22 as shown from the side opposite that depicted in FIG. 4. The illustrated surface abuts the door when the security bar 22 is attached thereto. FIG. 4 shows the security bar securing holes 30 and protective sheath securing notches 32 that are described above. Also shown is a clearance offset 34 which is slightly raised from the surrounding surface of the security bar 22. When the security bar 22 is attached to a door 12, the clearance offset 34 directly contacts the door 12 surface, leaving a gap between the door 12 and the remaining surface of the security bar 22. An insulating strip 36 that functions to dampen the impact between the double doors is likewise shown.

FIG. 6 depicts a cross sectional view of the security bar 22. As shown, the clearance offset 34 is slightly raised from the remaining portion of the security bar 22 surface. The clearance offset 34 directly contacts the surface of the door to which the security astragal 20 is attached. The insulating strip 36 is also raised from the surface of the security bar 22 but remains exposed when the security astragal 20 is attached to the door.

FIGS. 7 and 8 illustrate characteristics of the protective sheath 24. As shown in FIG. 7, which shows a representative portion of the protective sheath 24, the protective sheath 24 has a length commensurate with, and width slightly greater than, the security astragal 22. The protective sheath securing holes 38 line the edges of the protective sheath 24. When the protective sheath 24 is in place over the security bar 22, protective sheath securing screws 28 can be inserted into the securing holes 38. The screws extend to points within the protective sheath securing notches 32 located on the security bar 22 and function to hold the protective sheath 24 in place.

FIG. 8 provides a sectional view of the protective sheath 24. As shown, the edges of the protective sheath 24 are curved to form channels. The channels function as a guide so that the protective sheath 24 can be slidably moved over the security bar 22. When in place, the protective sheath 24 envelops the exterior of the security bar 22, so that the security bar anchoring screws 26 cannot be accessed.

Figure 10:
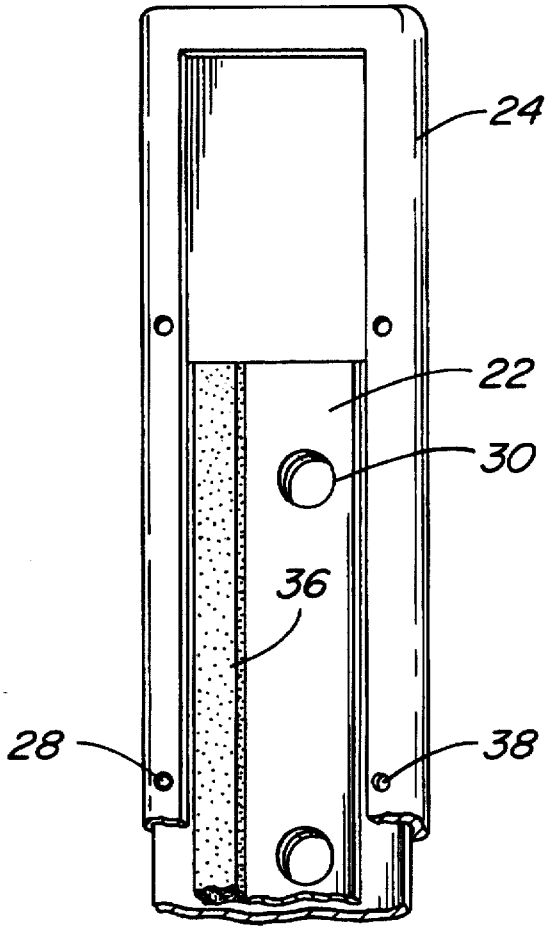
FIG. 10 is a view of the security bar partially enveloped in the protective sheath from a perspective opposite of that depicted FIG. 9.
Figure 11:
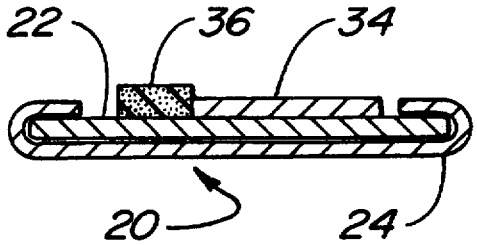
FIG. 11 is a sectional view of the security bar enveloped within th protective sheath.

FIGS. 9, 10, and 11 demonstrate the protective sheath and security bar in tandem. FIG. 9 is a frontal view of the protective sheath 24 partially in place over the security bar 22. The security bar 22 fits snugly within the channels formed by the edges of the protective sheath 24. As shown, the protective sheath 24 covers the security bar anchoring screws 26 so they cannot be compromised.

FIG. 10 provides a view of the protective sheath 24 and security bar 22 from the side opposite that depicted in FIG. 9. As shown, the edges of the security bar 22 fit within the channels formed by the edges of the protective sheath 24. The protective sheath 24 covers the exterior of the security bar 22 but does not interfere with the security bar being secured to the door.

FIG. 11 is a section view of the security bar 22 enveloped within the protective sheath 24. As shown, the edges of the security bar 22 fit within the channels formed by the edges of the protective sheath 24.

Figure 12:
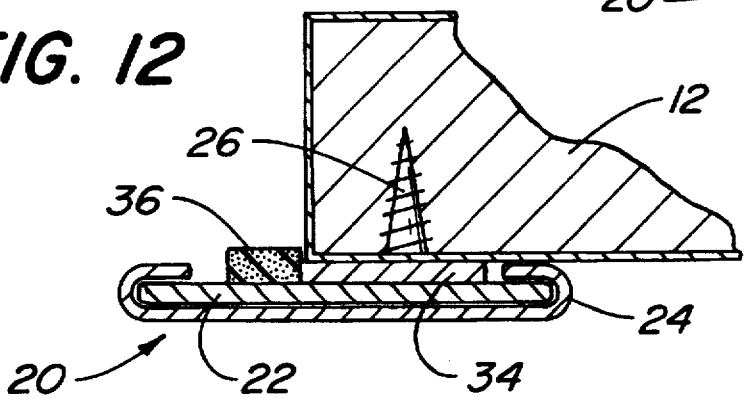
Fig. 12 is a sectional view of the assembled protective sheath attached to a standard door.

FIG. 12 is a cross-sectional view of the security astragal 20 attached to a door 12. As shown, the clearance offset 34 comes in direct contact with the surface of the door 12 to which it is secured. When the security bar is attached in such fashion, the remaining surfaces of the security bar 22 are left at a distance from the door, providing clearance for the protective sheath 24 to be slidably moved over the security bar 22. Also shown is the insulating strip 36. The insulating strip 36 is exposed so that it will contact the second door in the double doorway when the two are closed.

The present invention may be employed in other specific forms without departing from the spirit or essential attributes thereof. For example, a security bar with a different means of attaching to a door or a different shape may be employed. Similarly, a protective sheath, also with a different shape and securing mechanism, could be used. Accordingly, the scope of protection of the following claims is not limited to the presently preferred embodiment disclosed above.

I claim:

1. A combination comprising:

(a) a door;

(b) a security bar fastened to said door so as to overlap an edge of said door, said security bar having a length and a width; and (c) a removable protective sheath positioned and secured over said security bar, wherein said protective sheath has a length substantially the same as the length of said security bar and a width slightly greater than the width of said security bar.

2. A combination as recited in claim 1 wherein said security bar comprises a substantially flat elongated bar with holes for receiving anchoring screws.

3. A combination as recited in claim 1 wherein said security bar has a clearance offset for displacing said security bar from said door when fastened thereto so as to provide clearance for said protective sheath to fit over said security bar.

4. A combination as recited in claim 1 and further comprising an insulating material attached to said security bar so as not to interfere with latching of said door when said door is in a closed position.

5. A combination as recited in claim 3 wherein said security bar has insulating material affixed thereto.

6. A combination as recited in claim 1 wherein said security bar comprises a substantially flat elongated bar having securing notches for receiving protective sheath securing screws.

7. A combination as recited in claim 1 wherein said protective sheath comprises a substantially flat piece of rigid material with two parallel channeled sections for receiving said security bar into said protective sheath.

8. A combination as recited in claim 2 wherein said protective sheath has holes along said parallel channeled sections for accepting sheath securing screws, said sheath securing screws aligning with securing notches in said security bar.

9. A combination as recited in claim 1 wherein said protective sheath is made of metal.

10. A combination as recited in claim 1 wherein said security bar is made of metal.

11. A combination as recited in claim 1 wherein said protective sheath is made of steel.

12. A combination as recited in claim 1 wherein said security bar is made of steel.

13. A combination as recited in claim 1 wherein said security bar comprises a substantially flat elongated bar with holes for receiving anchoring screws; wherein said security bar has a clearance offset for displacing said security bar from said door when fastened thereto so as to provide clearance for said protective sheath to fit over said security bar; wherein said security bar has insulating material affixed thereto; wherein said security bar comprises a substantially flat elongated bar having securing notches for receiving protective sheath securing screws; wherein said protective sheath comprises a substantially flat piece of rigid material with two parallel channeled sections for receiving said security bar into said protective sheath; wherein said protective sheath has holes along said parallel channeled sections for accepting sheath securing screws, said sheath securing screws aligning with said securing notches in said security bar; and wherein said protective sheath is made of metal; wherein said security bar is made of metal.

14. A combination comprising a double door arrangement for enclosing an entrance and a security astragal comprising (a) a security bar constructed to be fastened to a single door in said double door arrangement so as to overlap an edge of said single door, said security bar having a length and a width; and (b) a removable protective sheath constructed to be positioned and secured over said security bar; wherein said protective sheath has a length substantially the same as the length of said security bar and a width slightly greater than the width of said security bar.

15. A combination as recited in claim 14 wherein said security bar comprises a substantially flat elongated bar with holes for receiving anchoring screws.

16. A combination as recited in claim 14, wherein said security bar has a clearance offset for displacing said security bar from said door when fastened thereto so as to provide clearance for said protective sheath to fit over said security bar.

17. A combination as recited in claim 14 and further comprising insulating material attached to said security bar so as not to interfere with latching of said double door arrangement when said double door arrangement is in a closed position.

18. A combination as recited in claim 14 wherein said security bar has insulating material affixed thereto.

19. A combination as recited in claim 14 wherein said security bar comprises a substantially flat elongated bar having securing notches for receiving protective sheath securing screws.

20. A combination as recited in claim 14, wherein said protective sheath comprises a substantially flat piece of rigid material with two parallel channeled sections for receiving said security bar into said protective sheath.

21. A combination as recited in claim 20 wherein said protective sheath has holes along said parallel channeled sections for accepting sheath securing screws, said sheath securing screws aligning with securing notches in said security bar.

22. A combination as recited in claim 14 wherein said protective sheath is made of metal.

23. A combination as recited in claim 14 wherein said security bar is made of metal.

24. A combination as recited in claim 14 wherein said protective sheath is made of steel.

25. A combination as recited in claim 14 wherein said security bar is made of steel.

26. A combination as recited in claim 14:

wherein said security bar comprises a substantially flat elongated bar with holes for receiving anchoring screws;

wherein said security bar has a clearance offset for displacing said security bar from said door when fastened thereto so as to provide clearance for said protective sheath to fit over said security bar;

wherein said security bar has insulating material affixed thereto;

wherein said security bar comprises a substantially flat elongated bar having securing notches for receiving protective sheath securing screws;

wherein said protective sheath comprises a substantially flat piece of rigid material with two parallel channeled sections for receiving said security bar into said protective sheath;

wherein said protective sheath has holes along said parallel channeled sections for accepting sheath securing screws, said sheath securing screws aligning with said securing notches in said security bar;

wherein said protective sheath is made of metal; and wherein said security bar is made of metal.

* * * * *